US010424235B2

(12) United States Patent
Xie et al.

(10) Patent No.: US 10,424,235 B2
(45) Date of Patent: Sep. 24, 2019

(54) CONTROL DEVICE FOR PROVIDING OUTPUT ERROR PROTECTION FUNCTION FOR GATE DRIVING CIRCUIT, DISPLAY PANEL AND DISPLAY DEVICE

(71) Applicants: BOE TECHNOLOGY GROUP CO., LTD., Beijing (CN); BEIJING BOE DISPLAY TECHNOLOGY CO., LTD, Beijing (CN)

(72) Inventors: Yu Xie, Beijing (CN); Yichiang Lai, Beijing (CN); Weibiao Geng, Beijing (CN); Dongqi Liu, Beijing (CN); Zhihan Zhou, Beijing (CN); Guangquan He, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 107 days.

(21) Appl. No.: 15/521,594

(22) PCT Filed: Oct. 27, 2016

(86) PCT No.: PCT/CN2016/103474
§ 371 (c)(1),
(2) Date: Apr. 24, 2017

(87) PCT Pub. No.: WO2017/118169
PCT Pub. Date: Jul. 13, 2017

(65) Prior Publication Data

US 2018/0005564 A1 Jan. 4, 2018

(30) Foreign Application Priority Data

Jan. 4, 2016 (CN) ..... 2016 1 0004272

(51) Int. Cl.
*G09G 3/20* (2006.01)
*G09G 3/36* (2006.01)

(52) U.S. Cl.
CPC ..... *G09G 3/2092* (2013.01); *G09G 3/20* (2013.01); *G09G 3/36* (2013.01); *G09G 2300/08* (2013.01);
(Continued)

(58) Field of Classification Search
None
See application file for complete search history.

(56) References Cited

U.S. PATENT DOCUMENTS 3,733,435 A * 5/1973 Chodil ..... G09G 3/2014 315/169.1
4,378,557 A * 3/1983 Murata ..... G09G 3/3644 345/208
(Continued)

FOREIGN PATENT DOCUMENTS

CN 101309077 A 11/2008
CN 101950520 A 1/2011
(Continued)

OTHER PUBLICATIONS

International Search Report with English language translation, dated Feb. 7, 2017, International Application No. PCT/CN2016/103474 (14 pages).
(Continued)

*Primary Examiner* — Chad M Dicke
(74) *Attorney, Agent, or Firm* — Womble Bond Dickinson (US) LLP

(57) ABSTRACT

The embodiments of the application disclose a control device for a gate driving circuit, a display panel and a display device. The control device for a gate driving circuit provided in the embodiment comprises a level shifter and a
(Continued)

control module electrically connected with an output of the level shifter. The control module is used for controlling an output signal of the level shifter to be a low level signal when each input clock signal for the level shifter is low.

9 Claims, 5 Drawing Sheets

(52) U.S. Cl.
CPC ..... *G09G 2310/0267* (2013.01); *G09G 2310/0289* (2013.01); *G09G 2310/08* (2013.01); *G09G 2330/08* (2013.01)

(56) References Cited

U.S. PATENT DOCUMENTS 6,411,302 B1* 6/2002 Chiraz ..... G06F 3/1431 345/531
6,967,688 B1* 11/2005 Morrish ..... G09G 5/18 345/213
2003/0034948 A1* 2/2003 Imamura ..... G09G 3/3622 345/98
2003/0214477 A1* 11/2003 Murakami ..... G09G 3/3611 345/100
2004/0125069 A1* 7/2004 Park ..... G09G 3/3666 345/100
2005/0264513 A1* 12/2005 Lim ..... G11C 19/28 345/100
2006/0103620 A1* 5/2006 Joo ..... G09G 3/3611 345/98
2006/0197554 A1* 9/2006 Jinta ..... G11C 19/184 326/81
2007/0262976 A1* 11/2007 Matsuda ..... G09G 3/3611 345/208
2008/0100558 A1* 5/2008 Yu ..... G09G 3/3677 345/100
2008/0136809 A1* 6/2008 Lee ..... G09G 3/3677 345/214
2008/0158204 A1 7/2008 Chang et al.
2008/0224755 A1 9/2008 Jo
2008/0316154 A1* 12/2008 Kim ..... G09G 3/3655 345/87
2010/0134478 A1* 6/2010 Moon ..... G09G 3/293 345/214
2011/0157123 A1* 6/2011 Cho ..... G09G 3/3266 345/211
2011/0157148 A1* 6/2011 Jang ..... G09G 3/3677 345/213
2012/0098842 A1* 4/2012 Manz ..... G09G 3/006 345/522
2013/0082996 A1* 4/2013 Kim ..... G09G 3/3677 345/210
2013/0249781 A1 9/2013 Park
2015/0318849 A1* 11/2015 Wu ..... H03K 17/28 327/393
2015/0364078 A1 12/2015 Shim et al.

FOREIGN PATENT DOCUMENTS

CN 104966503 A 10/2015
CN 105609067 A 5/2016
KR 20130107912 A 10/2013
TW 200828233 A 7/2008
WO WO2006040904 A1 4/2006

OTHER PUBLICATIONS

Office Action in Chinese Application No. 201610004272.8 dated Aug. 1, 2017, with English translation.
Office Action received for Chinese Patent Application No. 201610004272.8, dated Jan. 30, 2018, 29 pages. (17 pages of English Translation and 12 pages of Office Action).

* cited by examiner

CONTROL DEVICE FOR PROVIDING OUTPUT ERROR PROTECTION FUNCTION FOR GATE DRIVING CIRCUIT, DISPLAY PANEL AND DISPLAY DEVICE

RELATED APPLICATIONS

The present application is the U.S. national phase entry of PCT/CN2016/103474, with an international filling date of Oct. 27, 2016, which claims the benefit of Chinese Patent Application NO. 201610004272.8 filed on Jan. 4, 2016, the entire disclosure of which is incorporated herein by reference.

FIELD OF THE INVENTION

The present application relates to the field of display technologies, and in particular to a control device for a gate driving circuit, a display panel comprising the control device and a display device comprising the display panel.

BACKGROUND

In the field of display technology, a gate driving circuit is a circuit for providing driving signals to pixel switches in a pixel circuit. As shown in FIG. 1, a gate driving circuit usually comprises a plurality of cascaded gate driving units (for example, gate driving units 1, 2, 3), which can provide driving signals to pixel units of different rows. In order to generate the driving signals corresponding to the pixel units of different rows, the gate driving circuit typically requires clock signals as control signals. For example, FIG. 1 schematically shows that two clock signals CLK1 and CLK2 are provided to the gate driving circuit. The clock signals (e.g., CLK1 and CLK2) provided to the gate driving circuit can be generated by a level shifter.

However, the existing level shifter for a gate driving circuit has no output error protection function, so it may output an improper clock signal in some occasions, and as a result, the gate driving circuit will output an erroneous driving signal.

SUMMARY

Embodiments of the disclosure provide a control device for a gate driving circuit, a display panel and a display device, for providing an output error protection function for the gate driving circuit.

The control device for a gate driving circuit according to the embodiments of the present invention comprises a level shifter and a control module electrically connected with an output of the level shifter. The control module is used for controlling an output signal of the level shifter to be a low level signal when each input clock signal for the level shifter is low.

With the control device provided in the embodiments of the invention, when the input clock signals for the level shifter are all low level signals, the signal outputted by the level shifter can be controlled to be a low level, which avoids the problem that the output signal is not a low level signal when the input clock signals for the level shifter are all pulled low, and provides an output error protection function for the level shifter.

In some embodiments, the control module comprises a logic unit and a switching element electrically connected with an output of the logic unit, the switching element being electrically connected with a low level reference signal, the logic unit being further electrically connected with each input clock signal for the level shifter. The logic unit is used for controlling the switching element to be switched on when each input clock signal for the level shifter is low, such that the low level reference signal is provided to the output of the level shifter.

In some embodiments, the switching element is an N-type field effect transistor, and the output of the logic unit is connected to the gate of the N-type field effect transistor, a first terminal of the N-type field effect transistor being connected with the low level reference signal and a second terminal of the N-type field effect transistor being connected with the output of the level shifter.

In some embodiments, the switching element is a P-type field effect transistor, and the output of the logic unit is connected to the gate of the P-type field effect transistor, a first terminal of the P-type field effect transistor being connected with the low level reference signal and a second terminal of the P-type field effect transistor being connected with the output of the level shifter.

In some embodiments, the logic unit comprises three OR gates and one NOT gate. The level shifter receives four input clock signals. A first input clock signal and a second input clock signal for the level shifter are inputted into a first OR gate, a third input clock signal and a fourth input clock signal for the level shifter are inputted into a second OR gate, output signals of the first OR gate and the second OR gate are inputted into a third OR gate respectively, an output signal of the third OR gate is inputted into the NOT gate, and an output signal of the NOT gate serves as an output signal of the logic unit.

In some embodiments, the control module comprises a timing controller and a switching element connected with an output of the timing controller, the switching element being electrically connected with the low level reference signal, the timing controller being further electrically connected with each input clock signal for the level shifter. The timing controller is used for controlling the switching element to be switched on when each input clock signal for the level shifter is low, such that the low level reference signal is provided to the output of the level shifter.

In some embodiments, the output of the timing controller is connected to a control terminal of the switching element, a first terminal of the switching element being connected with the low level reference signal, a second terminal of the switching element being connected with the output of the level shifter.

In some embodiments, the switching element is an N-type field effect transistor, and the level shifter receives a first input clock signal, a second input clock signal, a third input clock signal, and a fourth input clock signal, the timing controller is used for outputting a high level signal when each input clock signal for the level shifter is low, such that the N-type field effect transistor is switched on.

In some embodiments, the switching element is a P-type field effect transistor, and the level shifter receives a first input clock signal, a second input clock signal, a third input clock signal, and a fourth input clock signal, the timing controller is used for outputting a low level signal when each input clock signal for the level shifter is low, such that the P-type field effect transistor is switched on.

In another embodiment of the present invention, a display panel is provided, comprising the control device according to any one of the above embodiments.

In yet another embodiment of the present invention, a display device is provided. The display device can comprise the display panel according to the above embodiment.

DETAILED DESCRIPTION OF EMBODIMENTS

The embodiments of the disclosure will be described below by way of specific examples. It can be understood that, the illustrated examples are only part of the embodiments of the invention, instead of all of them. Based on principles disclosed in the embodiments described below, a person having an ordinary skill in the art can make proper modifications or variations to the described embodiments, thereby obtaining different embodiments. These all fall within the scopes of claims of the application.

The term "electrically connected" herein refers to forming a path electrically, and includes both direct connection and indirect connection. The terms "first terminal" and "second terminal" herein refer to two terminals of a switching element except for a control terminal, and moreover, the "first terminal" and the "second terminal" herein can be exchanged as they are not distinguished from each other. For example, for a field effect transistor, the first terminal can refer to either of the source and the drain, and the second terminal refers to the other of the source and the drain.

Figure 1:
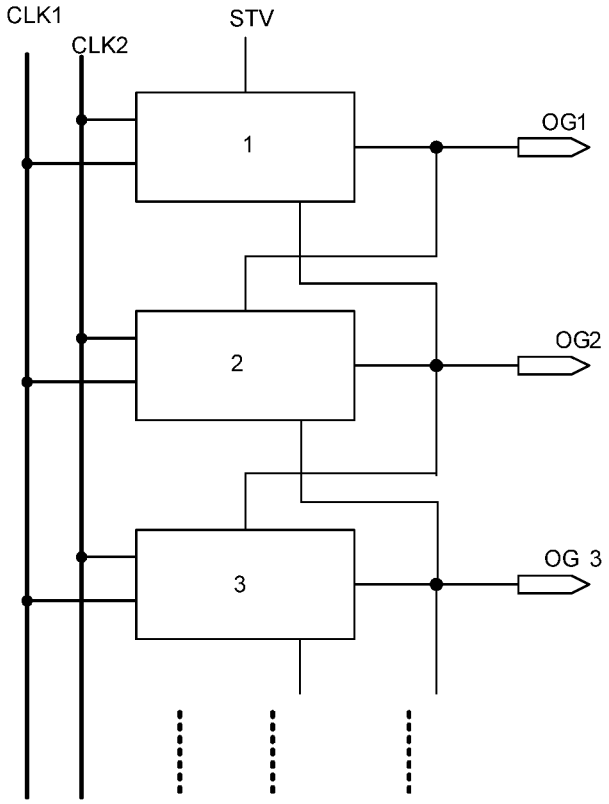
FIG. 1 schematically shows a structural diagram of a gate driving circuit.
Figure 2:
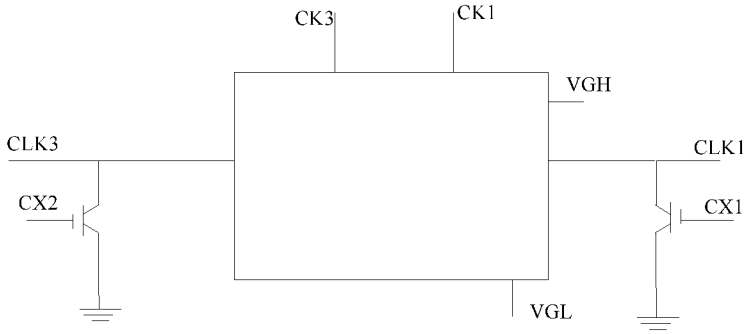
FIG. 2 shows a schematic view of a level shifter for a gate driving circuit.

FIG. 2 shows a schematic view of a level shifter for a gate driving circuit. In actual applications, the level shifter can be in the form of an integrated circuit having a function of amplifying a voltage level. In the example as shown in FIG. 2, the level shifter can receive two input signals CK1 and CK3, and can provide two output clock signals CLK1 and CLK3. The two output clock signals CLK1 and CLK3 can be provided to the gate driving circuit as a control signal.

In the example of FIG. 2, a peripheral circuit of the level shifter further comprises switching elements (for example, field effect transistors) electrically connected with the output clock signals CLK1 and CLK3 respectively, and control terminals of the two switching elements may be controlled by control signals CX1 and CX2 respectively. For instance, when the display device comprising this level shifter is deactivated, the two switching elements can be switched on respectively under the control of the control signals CX1 and CX2, such that the output clock signals CLK1 and CLK3 are connected with a reference ground, and thereby providing of effective control signals for the gate driving circuit is ceased.

Figure 3:
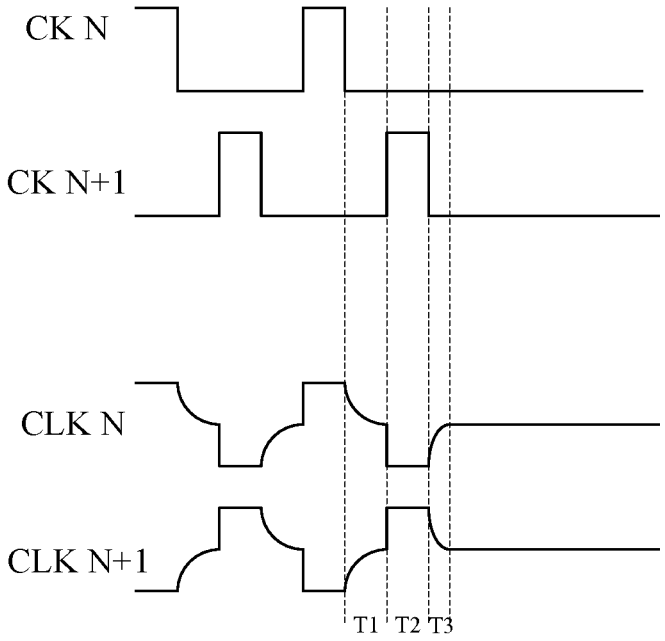
FIG. 3 schematically shows a possible timing diagram of input signals and output clock signals for an existing level shifter.

FIG. 3 schematically shows a possible timing diagram of input signals and output clock signals for the existing level shifter. Referring to FIG. 2 and FIG. 3, the level shifter can be controlled such that when the input signals CK N and CK N+1 are both low (e.g., in time period T1 as shown in FIG. 3), two output clocks signals CLK N and CLK N+1 with opposite levels are electrically connected with each other, and thereby a signal with an intermediate level is obtained. In this way, an electricity-saving effect can be achieved. Subsequently, in time period T2, one of the input signals CK N and CK N+1 becomes high, and the level shifter can output a normal clock signal. However, upon termination of signals of a frame, for example, in time period T3 as shown in FIG. 3, the output clock signals CLK N and CLK N+1 will always be electrically connected with each other because the input signals CK N and CK N+1 will not become high at this time. Therefore, the output clock signals CLK N and CLK N+1 may remain at an intermediate level until a next frame starts, thus the level shifter will not provide correct control signals to the gate driving circuit.

As shown in FIG. 3, in other words, when the input signals for the level shifter are all low, the output clock signals of the level shifter will not become low level signals based on the input signals, which may cause the gate driving circuit to output improper driving signals and switch on pixel units erroneously.

Figure 4:
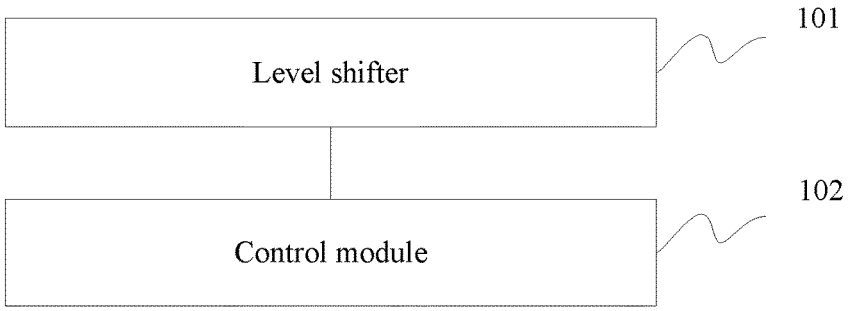
FIG. 4 schematically shows a structural diagram of a control device for a gate driving circuit according to an embodiment of the invention.

FIG. 4 schematically shows a control device for a gate driving circuit according to an embodiments of the invention, comprising a level shifter 101 and a control module 102. The control module 102 is electrically connected with an output of the level shifter 101. The control module 102 is used for controlling an output signal of the level shifter 101 to be a low level signal when each input clock signal of the level shifter 101 is low.

As discussed above, in this embodiment, the level shifter 101 can provide the gate driving circuit with one or more clock signals as control signals, and the level shifter 101 may receive one or more input clock signals. Although FIG. 2 and FIG. 3 show two input clock signals, a level shifter requiring more input clock signals can be designed upon actual needs of the gate driving circuit.

For the embodiment as shown in FIG. 4, by designing a control module connected with the output of the level shifter, the signal outputted by the level shifter can be controlled to be a low level signal when each input clock signal for the level shifter is low, which may provide an output error protection function for the level shifter, alleviates or avoids the possibility of erroneous driving signals outputted by the gate driving circuit and thus prevents the pixel units from being switched on erroneously.

In the embodiments of the disclosure, by arranging a logic unit or a timing controller at the periphery of the level shifter, the output clock signal of the level shifter can be pulled low to prevent abnormal output of the level shifter when each input clock signal for the level shifter is low. Apparently, an applicable control module is not limited to the logic unit or the timing controller illustrated in some embodiments.

Figure 5:
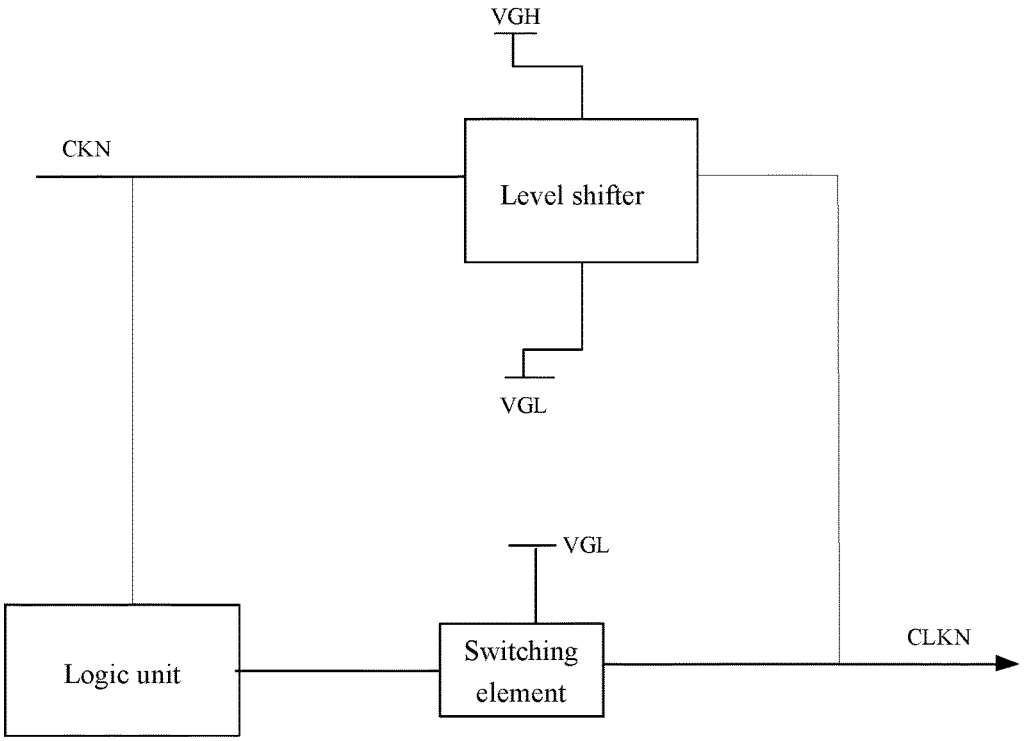
FIG. 5 schematically shows a structural diagram of a level shifter and a control module in the control device according to an embodiment of the invention.

According to an embodiment of the invention, as shown in FIG. 5, the control module can comprise a logic unit and a switching element electrically connected with an output of the logic unit, the switching element being electrically connected with a low level reference signal VGL. The logic unit may be further electrically connected with each input clock signals CKN for the level shifter, and the logic unit is used for controlling the switching element to be switched on when each input clock signal CKN for the level shifter is low, such that the low level reference signal VGL is provided to the output of the level shifter.

Figure 6:
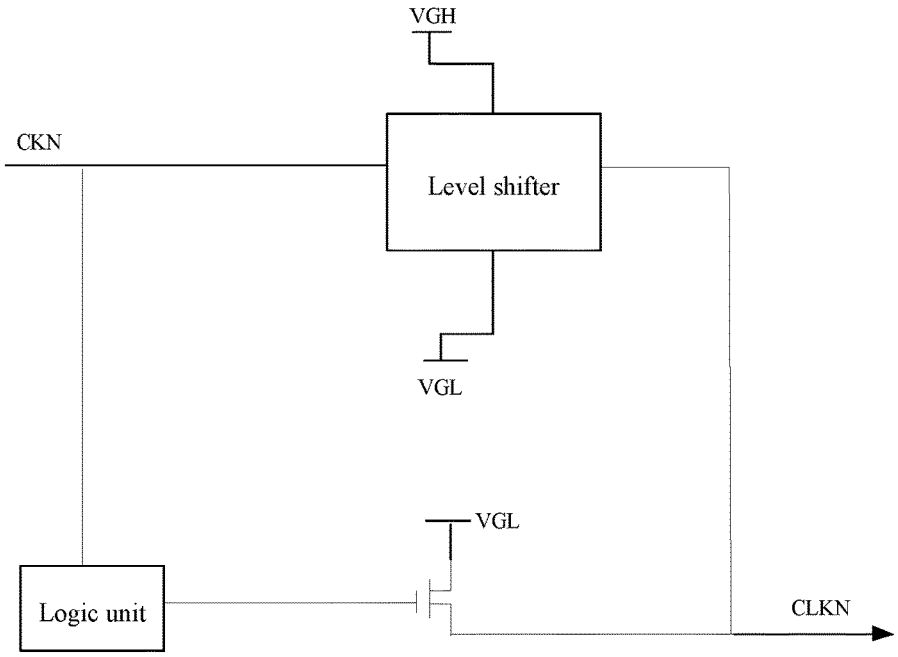
FIG. 6 schematically shows a structural diagram of a level shifter and a control module in the control device according to an embodiment of the invention.

In some embodiments, as shown in FIG. 6, the switching element can be an N-type field effect transistor, and the output of the logic unit is connected to the gate of the N-type field effect transistor, a first terminal of the N-type field effect transistor being connected with the low level reference signal VGL and a second terminal of the N-type field effect transistor being connected with the output of the level shifter.

Therefore, in this embodiment, the logic unit may be designed to output a high level signal when the input clock signals to the level shifter are all low level signals such that the N-type field effect transistor is switched on, and as a result, the signal outputted by the level shifter is a low level signal at this time.

It can be understood that although FIG. 6 shows that the switching element comprises only one N-type field effect transistor, the switching element may also comprise more than one field effect transistors or other types of switches, as long as an electrical connection between the low level reference signal VGL and the output of the level shifter can be achieved by means of this switching element under the control of the output signal from the logic unit.

Alternatively, the switching element may be a P-type field effect transistor, and the output of the logic unit is connected to the gate of the P-type field effect transistor, a first terminal of the P-type field effect transistor being connected with the low level reference signal VGL and a second terminal of the P-type field effect transistor being connected with the output of the level shifter.

In this case, the logic unit may be designed to output a low level signal when the input clock signals to the level shifter are all low, such that the P-type field effect transistor is switched on.

Figure 7:
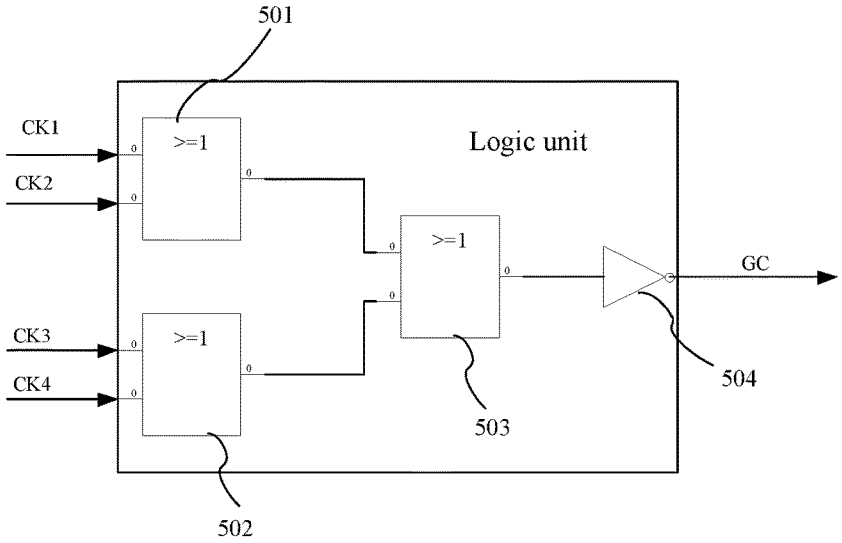
FIG. 7 schematically shows a structural diagram of a logic unit in a control device according to an embodiment of the invention.

FIG. 7 schematically shows a structure of a logic unit in a control device according to an embodiment of the invention. As shown in FIG. 7, the logic unit may comprise three OR gates and one NOT gate. A first input clock signal CK1 and a second input clock signal CK2 for the level shifter are inputted into a first OR gate 501. A third input clock signal CK3 and a fourth input clock signal CK4 for the level shifter are inputted into a second OR gate 502. Output signals of the first OR gate 501 and the second OR gate 502 are inputted into a third OR gate 503 respectively. An output signal of the third OR gate 503 is inputted into the NOT gate 504. An output signal GC of the NOT gate 504 serves as an output signal of the logic unit. That is, the embodiment as shown in FIG. 7 corresponds to a level shifter capable of receiving four input clock signals. In this embodiment, if and only if the four input clock signals CK1~CK4 are all low, the signal GC outputted by the logic unit is high. As can be seen from FIG. 7, if the four input clock signals CK1~CK4 are not all low, GC will be low, and the N-type field effect transistor controlled by the logic unit will not be switched on, and accordingly the level shifter will normally provide the output clock signal CLK N.

As shown in FIG. 6, when the logic unit outputs a high level, the N-type field effect transistor will be switched on such that the output clock signal CLK N of the level shifter is electrically connected to the low level reference signal VGL. Consequently, the outputs of the level shifter will be all pulled low, which prevents the gate driving circuit from outputting erroneous driving signals.

In case of a P-type field effect transistor serving as the switching element, the NOT gate 504 can be removed from the logic unit as shown in FIG. 7, thereby to obtain a control module suitable for controlling a P-type field effect transistor.

It should be noted that the structures of the logic unit described above are only exemplary, and the control module can also be a logic unit with other structures. Moreover, the signals inputted into the logic unit are not limited to the four input clock signals CK1~CK4, but instead they can be any other numbers of input clock signals.

According to another embodiment of the invention, the control module can comprise a timing controller and a switching element connected with an output of the timing controller, the switching element being electrically connected with the low level reference signal, the timing controller being further electrically connected with each input clock signal to the level shifter. The timing controller is used for controlling the switching element to be switched on when each input clock signal to the level shifter is low, such that the low level reference signal is provided to the output of the level shifter.

Figure 8:
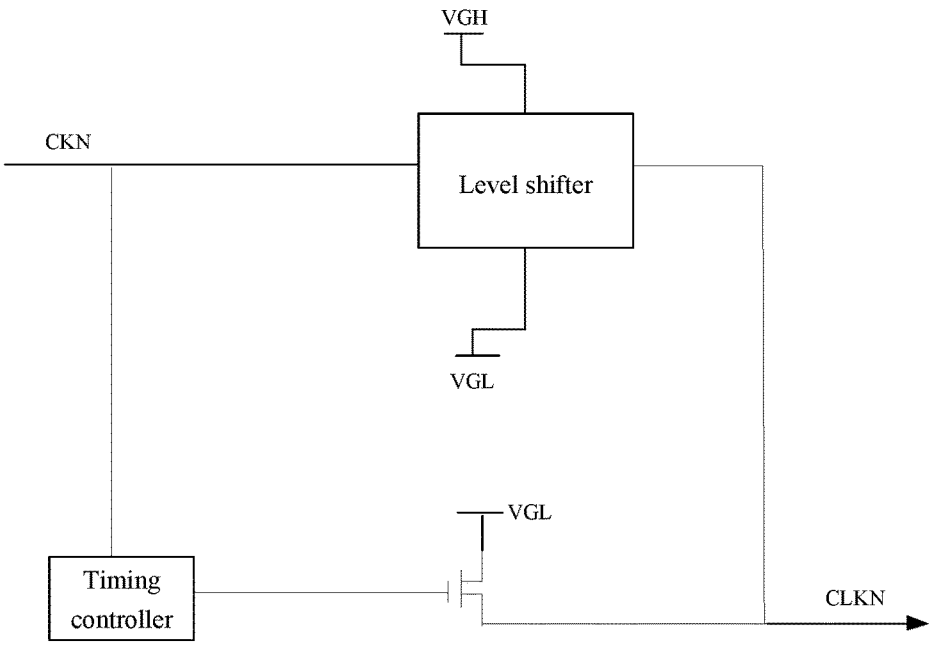
FIG. 8 schematically shows a structural diagram of a level shifter and a control module in a control device according to another embodiment of the invention.

As shown in FIG. 8, in an embodiment, the output of the timing controller can be connected to a control terminal of the switching element, and a first terminal of the switching element is connected with the low level reference signal VGL, and a second terminal of the switching element is connected with the output CLK N of the level shifter.

In some embodiments, the switching element is an N-type field effect transistor (e.g., as shown in FIG. 8), and the level shifter receives the first input clock signal, the second input clock signal, the third input clock signal, and the fourth input clock signal, and the timing controller is used for outputting a high level signal when each input clock signal for the level shifter is low, such that the N-type field effect transistor is switched on.

Alternatively, in other embodiments, the switching element can be a P-type field effect transistor, and the level shifter receives the first input clock signal, the second input clock signal, the third input clock signal, and the fourth input clock signal. The timing controller is used for outputting a low level signal when each input clock signal to the level shifter is low, such that the P-type field effect transistor is switched on.

The timing controller in the embodiments can be a programmable integrated circuit chip such as a Single Chip Microcomputer (SCM), and input signal pins of the chip can be electrically connected to the input clock signals for the level shifter, and output pins thereof can be electrically connected to the control terminal of the switching element. The timing controller can be programmed to output a corresponding control signal for switching on the switching element when each input clock signal for the level shifter is low, such that the low level reference signal is provided to the output of the level shifter via the switching element.

The internal structure of the timing controller is not specifically defined herein, as long as a program internally arranged enables the timing controller to output a control signal for switching on the switching element connected with the output of the timing controller when the input clock signals received are all low.

Figure 9:
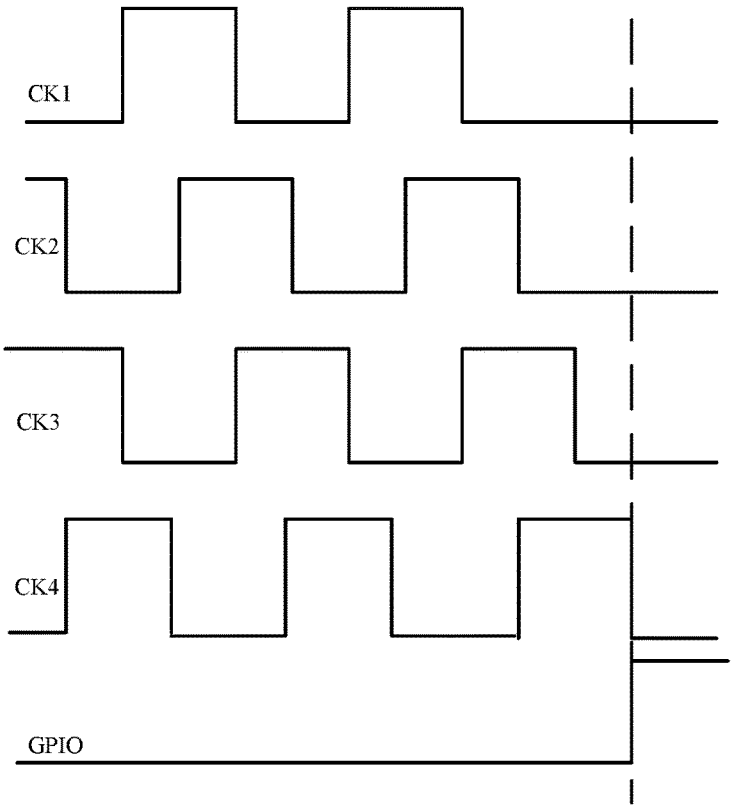
FIG. 9 is a schematic view showing the timing of the output signal of a timing controller and input clock signals for a level shifter in the control device according to an embodiment of the invention.

Referring to FIG. 9, for example, when a gate driving unit in the gate driving circuit needs to be reset, the clock signals (e.g., CK1~CK4) for the level shifter are all low, an output signal GPIO of the timing controller is high such that the N-type field effect transistor is switched on, and accordingly the low level reference signal is provided to the output of the level shifter via the N-type field effect transistor.

In another embodiment of the invention, a display panel is provided, which may comprise the control device according to any of the above embodiments.

In yet another embodiment of the invention, a display device is provided, which may comprise the display panel according to the above embodiment of the invention. The display device comprises but is not limited to a device having a display function, such as a display, a mobile phone, a tablet computer, a music player, a navigator and the like.

To sum up, the embodiments of the application provide a control device for a gate driving circuit, comprising a level shifter and a control module electrically connected with an output of the level shifter. The control module is used for controlling an output signal of the level shifter to be a low level signal when each input clock signal for the level shifter is low, which provides an output error protection function for the level shifter.

A person having an ordinary skill in the art should understand that the embodiments of the application can be implemented as a method, a device or a computer program product. Therefore, these embodiments can be implemented as complete hardware embodiments, complete software embodiments, or a combination thereof. Furthermore, the embodiments of the application can be in the form of a computer program product implemented on one or more computer-readable storage mediums (including but not limited to a magnetic storage device and an optical storage device) comprising computer-readable program codes.

The present disclosure is described with reference to flow diagrams and/or block diagrams of the method, the device (system) and the computer pogrom product according to the embodiments of the present application. It should be understood that each flow and/or block of the flow diagrams and/or the block diagrams and a combination thereof can be implemented by computer program instructions. These computer program instructions can be provided to a general-purpose computer, a dedicated computer, an embedded processor or a processor of other programmable data processing devices so as to produce a machine such that the instructions executed by the computer or the processor of other programmable data processing devices produce a means for implementing functions specified in one or more flows of a flow diagram and/or in one or more blocks of a block diagram.

These computer program instructions may also be stored in a computer-readable memory capable of directing a computer or other programmable data processing devices to operate in a particular manner, such that the instructions stored in the computer-readable memory produce an article of manufacture including an instruction means for implementing functions specified in one or more flows of a flow diagram and/or in one or more blocks of a block diagram.

The computer program instructions may also be loaded onto a computer or other programmable data processing devices to cause a series of operational steps to be performed on the computer or other programmable devices to produce a computer-implemented process such that the instructions executed on the computer or other programmable devices provide steps for implementing functions specified in one or more flows of a flow diagram and/or in one or more blocks of a block diagram.

Obviously, the person having an ordinary skill in the art can make various modifications and variations to this disclosure without deviating from spirits and scopes of the invention. Thus if these modifications and variations to the present disclosure pertain to the scope of the claims of the invention and equivalent technologies thereof, the present invention also intends to encompass these modifications and variations.

The invention claimed is:

1. A control device for a gate driving circuit, comprising:

a level shifter circuit; and a controller electrically connected with an output of the level shifter circuit, wherein the controller is used for controlling an output signal of the level shifter circuit to be a low level signal when each input clock signal for the level shifter circuit is low, wherein the controller comprises a switching element and a logic circuit, a control terminal of the switching element is electrically connected with an output of the logic circuit, a first terminal of the switching element is electrically connected with a low level reference signal, and a second terminal of the switching element is electrically connected with the output of the level shifter circuit, wherein the logic circuit is configured to receive each input clock signal for the level shifter circuit to generate a control signal to be provided to the control terminal of the switching element, and turn on the switching element by means of the control signal in response to each input clock signal being low such that the low level reference signal is provided to the output of the level shifter circuit, wherein the logic circuit comprises three OR gates and one NOT gate, and the level shifter circuit receives four input clock signals, wherein a first input clock signal and a second input clock signal for the level shifter circuit are inputted into a first OR gate, a third input clock signal and a fourth input clock signal for the level shifter circuit are inputted into a second OR gate, output signals of the first OR gate and the second OR gate are inputted into a third OR gate respectively, an output signal of the third OR gate is inputted into the NOT gate, and an output signal of the NOT gate serves as an output signal of the logic circuit.

2. The control device according to claim 1, wherein the switching element is an N-type field effect transistor, and the output of the logic circuit is connected to a gate of the N-type field effect transistor, a first terminal of the N-type field effect transistor being connected with the low level reference signal and a second terminal of the N-type field effect transistor being connected with the output of the level shifter circuit.

3. The control device according to claim 1, wherein the switching element is a P-type field effect transistor, and the output of the logic circuit is connected to a gate of the P-type field effect transistor, a first terminal of the P-type field effect transistor being connected with the low level reference signal and a second terminal of the P-type field effect transistor being connected with the output of the level shifter circuit.

4. A control device for a gate driving circuit, comprising:

a level shifter circuit; and a controller electrically connected with an output of the level shifter circuit, wherein the controller is used for controlling an output signal of the level shifter circuit to be a low level signal when each input clock signal for the level shifter circuit is low, wherein the controller comprises a logic circuit and a switching element electrically connected with an output of the logic circuit, the switching element being electrically connected with a low level reference signal, the logic circuit being further electrically connected with each input clock signal for the level shifter circuit, wherein the logic circuit is used for controlling the switching element to be switched on when each input clock signal for the level shifter circuit is low, such that the low level reference signal is provided to the output of the level shifter circuit, wherein the switching element is an N-type field effect transistor, and the output of the logic circuit is connected to a gate of the N-type field effect transistor, a first terminal of the N-type field effect transistor being connected with the low level reference signal and a second terminal of the N-type field effect transistor being connected with the output of the level shifter circuit, wherein the logic circuit comprises three OR gates and one NOT gate, and the level shifter circuit receives four input clock signals, wherein a first input clock signal and a second input clock signal for the level shifter circuit are inputted into a first OR gate, a third input clock signal and a fourth input clock signal for the level shifter circuit are inputted into a second OR gate, output signals of the first OR gate and the second OR gate are inputted into a third OR gate respectively, an output signal of the third OR gate is inputted into the NOT gate, and an output signal of the NOT gate serves as an output signal of the logic circuit.

5. A display panel comprising the control device according to claim 1.

6. A display device comprising the display panel according to claim 5.

7. The display panel according to claim 5, wherein the switching element is an N-type field effect transistor, and the output of the logic circuit is connected to a gate of the N-type field effect transistor, a first terminal of the N-type field effect transistor being connected with the low level reference signal and a second terminal of the N-type field effect transistor being connected with the output of the level shifter circuit.

8. The display panel according to claim 5, wherein the switching element is a P-type field effect transistor, and the output of the logic circuit is connected to a gate of the P-type field effect transistor, a first terminal of the P-type field effect transistor being connected with the low level reference signal and a second terminal of the P-type field effect transistor being connected with the output of the level shifter circuit.

9. A display panel comprising a control device for a gate driving circuit, the control device comprising:

a level shifter circuit; and a controller electrically connected with an output of the level shifter circuit, wherein the controller is used for controlling an output signal of the level shifter circuit to be a low level signal when each input clock signal for the level shifter circuit is low, wherein the controller comprises a logic circuit and a switching element electrically connected with an output of the logic circuit, the switching element being electrically connected with a low level reference signal, the logic circuit being further electrically connected with each input clock signal for the level shifter circuit, wherein the logic circuit is used for controlling the switching element to be switched on when each input clock signal for the level shifter circuit is low, such that the low level reference signal is provided to the output of the level shifter circuit, wherein the switching element is an N-type field effect transistor, and the output of the logic circuit is connected to a gate of the N-type field effect transistor, a first terminal of the N-type field effect transistor being connected with the low level reference signal and a second terminal of the N-type field effect transistor being connected with the output of the level shifter circuit, wherein the logic circuit comprises three OR gates and one NOT gate, and the level shifter circuit receives four input clock signals, wherein a first input clock signal and a second input clock signal for the level shifter circuit are inputted into a first OR gate, a third input clock signal and a fourth input clock signal for the level shifter circuit are inputted into a second OR gate, output signals of the first OR gate and the second OR gate are inputted into a third OR gate respectively, an output signal of the third OR gate is inputted into the NOT gate, and an output signal of the NOT gate serves as an output signal of the logic circuit.

* * * * *